US007024807B2

(12) United States Patent
Street

(10) Patent No.: US 7,024,807 B2
(45) Date of Patent: Apr. 11, 2006

(54) GREETING CARD WITH SCANABLE GIFT CARD

(75) Inventor: Joseph W. Street, Mount Vernon, OH (US)

(73) Assignee: Ward-Kraft, Inc., Fort Scott, KS (US)

( * ) Notice: Subject to any disclaimer, the term of this patent is extended or adjusted under 35 U.S.C. 154(b) by 67 days.

(21) Appl. No.: 10/076,198

(22) Filed: Feb. 13, 2002

(65) Prior Publication Data

US 2003/0150142 A1 Aug. 14, 2003

(51) Int. Cl.
*G09F 1/00* (2006.01)

(52) U.S. Cl. ..... 40/124.06; 283/101

(58) Field of Classification Search ..... 40/124.06, 40/124.11, 124.01, 124.191; 283/99, 101, 283/62; 229/92.8; D19/10; 206/555
See application file for complete search history.

(56) References Cited

U.S. PATENT DOCUMENTS

| | | | | |
|---|---|---|---|---|
| 3,068,140 | A | 12/1962 | Biddle | |
| 3,697,101 | A | 10/1972 | Loos et al. | |
| 4,024,656 | A * | 5/1977 | Farnsworth | 40/124.11 X |
| 4,200,222 | A * | 4/1980 | Feuer | 40/124.11 X |
| 4,544,590 | A | 10/1985 | Egan | |
| 4,854,610 | A | 8/1989 | Kwiatek | 283/81 X |
| 4,890,862 | A | 1/1990 | Buchholz | 283/81 X |
| 4,982,894 | A | 1/1991 | Schmidt | 283/101 X |
| 4,983,438 | A | 1/1991 | Jameson | 283/101 X |
| 5,058,926 | A | 10/1991 | Drower | |
| 5,096,229 | A | 3/1992 | Carlson | |
| 5,098,759 | A | 3/1992 | Felix | |
| 5,129,682 | A | 7/1992 | Ashby | 283/81 |
| 5,316,345 | A * | 5/1994 | Madison | 283/117 |
| 5,403,236 | A | 4/1995 | Greig | |
| 5,629,977 | A * | 5/1997 | Fonesca | |
| 5,760,381 | A * | 6/1998 | Stich et al. | |
| 5,777,305 | A * | 7/1998 | Smith et al. | |
| 5,915,734 | A * | 6/1999 | Minehart | 283/117 |
| 5,918,909 | A | 7/1999 | Fiala et al. | |
| 6,493,970 | B1 * | 12/2002 | McCarthy et al. | 40/124.01 |
| 6,666,378 | B1 * | 12/2003 | Dávila et al. | |
| 6,698,116 | B1 * | 3/2004 | Waldron | 40/124.11 |
| 2003/0028439 | A1 * | 2/2003 | Cox et al. | 705/26 |

FOREIGN PATENT DOCUMENTS

| | | |
|---|---|---|
| EP | 0688006 | 12/1989 |
| EP | 0327754 | 8/1999 |

* cited by examiner

*Primary Examiner*—Joanne Silbermann
(74) *Attorney, Agent, or Firm*—Hovey Williams LLP

(57) ABSTRACT

A combination greeting card and gift card with a coded information portion is provided to be sold and delivered to a recipient as a unit. The greeting card includes preprinted indicia preferably corresponding to a particular occasion such as a birthday, holiday, graduation or other celebretory event. The coded information portion of the gift card preferably includes a PIN number or a scannable portion which, when an account in a remote computer corresponding to the coded information and the gift card is activated, enables the holder of the gift card to obtain goods or services by access to credit corresponding to the card from a remote database. The gift card is initially temporarily coupled to the greeting card by adhesive, tabs and slits, or a mechanical fastener, and concealed when the front and rear panels of the greeting card are in a closed, substantially parallel orientation.

13 Claims, 1 Drawing Sheet

GREETING CARD WITH SCANABLE GIFT CARD

BACKGROUND OF THE INVENTION

1. Field of the Invention

This invention relates generally to greeting cards which include a gift card having encoded information and which may be redeemed for goods or services. More particularly, it is concerned with a greeting card which functions as a carrier for a second card attached thereto having encoded information, most preferably in the form of a optically or magnetically scanable region which may be activated at the time of purchase whereby the recipient of the greeting card may use the card to purchase merchandise or services.

2. Description of the Prior Art

Greeting cards have long been used to convey congratulations or warm sentiment to recipients. A benefit of having preprinted greeting cards is that professional artwork and corresponding textual expression is provided to the purchaser, who may then add personal notes and/or sign the card. On many occasions, the sender of the card may include cash or a check as a present to the recipient. Some cards have been designed with special pockets to hold currency intended as a gift.

While greeting cards are very popular, they are a somewhat detached form of communication. The greeting card provides a means of conveying sentiment and a message, but is not interactive. Often, the sender of a card, such as a parent or grandparent, would like to convey a gift but also be the recipient of a telephone call from the child or grandchild, for example. Moreover, some gift-givers prefer to give something more specific than cash, such as gift certificates which are redeemable at specific merchants preferred by the recipient.

More recently, telephone calling cards have been manufactured and sold at retail. These telephone calling cards and the systems for their use are described generally in U.S. Pat. Nos. 4,706,275 and 5,918,909, the disclosures of which are incorporated herein by reference. The telephone calling cards are typically distributed as promotional items or displayed at retail, where they are attached to a cardboard panel which acts as a carrier. A portion of the telephone calling card carrying a magnetically encoded strip extends from the margin of the cardboard carrier. At the retail checkout stand, the telephone calling card is activated after the purchaser pays the required retail amount by "swiping" the encoded strip through an electronic reader. This activates the account for the card from a remote computer for a metered amount of telephone usage corresponding to the personal identification number or PIN particular to and identified on the card. This credits the account so that upon purchase, telephone usage is "prepaid". The user then dials in the PIN in the process of using the card, with the usage being deducted from the computer-held account until exhausted. When the available number of minutes of usage have been exhausted, any calls in progress are automatically terminated, and no further calls can be initiated from that card unless additional minutes are purchased for that PIN. In the case of sample cards or other prepaid cards, an account may be created without the necessity of scanning the card upon purchase. While these encoded areas are typically magnetically encoded strips, the encoded areas may also be provided as optically scannable blocks may also be employed to carry the account information from which purchases of goods or services may be deducted.

SUMMARY OF THE INVENTION

The present invention is intended to satisfy the need of the gift provider in providing a combination greeting card and gift which may be redeemed for goods or services by integrating an gift card with coded or encodable information with a greeting card. The gift card is coupled to the greeting card and thereby purchased as a unit, but may be detached from the greeting card by the recipient and then conveniently carried in a wallet or the like until redeemed for goods or services such as telephone services. The resulting combination provides convenience for both the purchaser and the card recipient, permits the gift card to be conveyed with a personalized sentiment, and allows the gift card to be initially concealed between the front and a second panel or other panel of the greeting card to provide an element of surprise. By coupling the gift card to one of the panels of the greeting card, slippage is avoided and both a preprinted sentiment and any personalized sentiment added by the giver can be fixed relative to the gift card at the time the recipient opens the greeting card to reveal the gift card therewithin.

The greeting card with encodable card of the present invention includes a greeting card having a front panel and a rear panel, with the gift card positioned between the front and rear panels and coupled to one of the panels of the greeting card by adhesive, slits forming tabs, or other retaining means whereby it is prepositioned relative to the greeting card. The greeting card is provided with preprinted indicia on at least one, and preferably both of the panels, which may include artwork or a sentiment. The indicia may be printed so that it is not obscured by the gift card, or, if desired, may be printed behind the gift card so that it is initially concealed until such time as the card is removed. The gift card hereof includes coded information thereon, such as a card having a personal identification number (PIN) or is a data scannable card. By "scannable card", it is understood that as described in U.S. Pat. No. 5,918,909, the card itself is merely read by a scanner, but that an account corresponding to the card is activated after scanning at the point of purchase. The present invention provides a combined product which may be purchased as a unit at retail, thereby avoiding waste normally found in the provision of a separate carrier packaging for the scanable card. The gift card having scanable information includes a magnetic strip, bar code or encoded electronic chip such as a transponder chip with radio frequency identification, any of which may be read by a corresponding scanning device well known to those skilled in the art. A cutout window may be provided in the panel of the greeting card to which the gift card is attached as an aid to the merchant initially scanning the gift card at the point of purchase. By scanning the information carried by the encodable strip, the account carried by a remote computer database is thereby activated to a credit amount corresponding to that purchased, so that the gift card may be utilized to purchase goods or services up to a predetermined amount of cash (dollars, Euros, etc.) or quantity (minutes of telephone service, number of commodities, etc.). The purchaser may then write an inscription or other personalized message on the greeting card and enclose it in an envelope together with the attached gift card. The recipient inherently views the indicia on the panels of the greeting card when opening the panels to reveal the gift card. The gift card may then be readily removed from the greeting card and held in a wallet or the like until the credit account is accessed by the recipient using the PIN number, scanning the encodable strip, or the like and the in the remote computer is debited until expended.

These and other advantages will be readily apparent to those skilled in the art with reference to the drawings and description which follow.

DESCRIPTION OF THE PREFERRED EMBODIMENT

Figure 1:
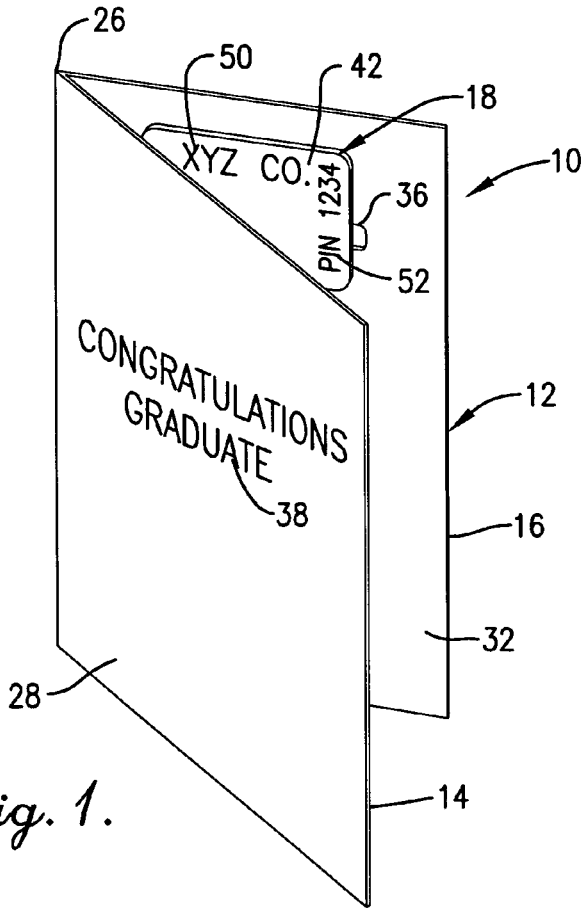
FIG. 1 is a front elevational view of the greeting card with encodable gift card of the present invention, showing a front panel of the greeting panel opened along a fold line to reveal the gift card carried within.
Figure 2:
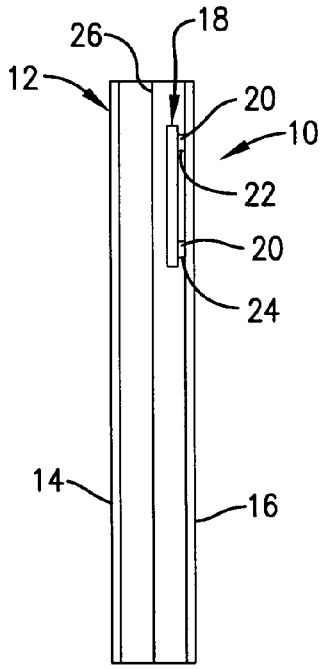
FIG. 2 is a right side elevational view showing the greeting card with the front panel in a closed position substantially parallel to the rear panel, and the gift card adhesively coupled to the rear panel.

Referring now to the drawings, a combination greeting card with scanable gift card 10 is shown in FIGS. 1–4 and broadly includes a greeting card portion 12 having a front panel 14 and a rear panel 16, a gift card 18 with coded information or an encodable area, and coupling means 20 for temporarily securing the gift card 18 to one of the panels. The coupling means 20 may be provided as areas of adhesive 22 and 24, a mechanical fastener such as a staple or the like, or slits in one of the panels which receive the corners or edges of the gift card and consequently providing tabs, any of which serve to hold the gift card in a desired initial position on the panel.

Figure 3:
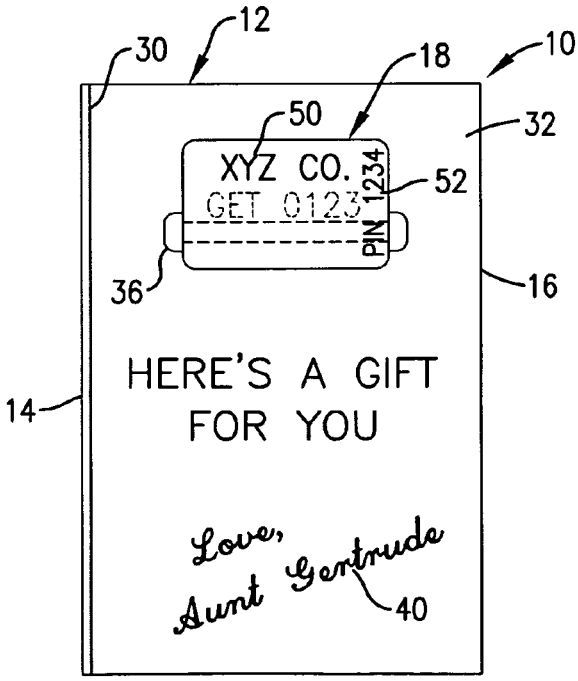
FIG. 3 is an elevational view similar to FIG. 1 but showing the front panel perpendicular to the rear panel of the greeting card to reveal the preprinted indicia and inscription written on the inside face of the rear panel, with an encoded scannable strip on the reverse side of the gift card shown in phantom lines.
Figure 4:
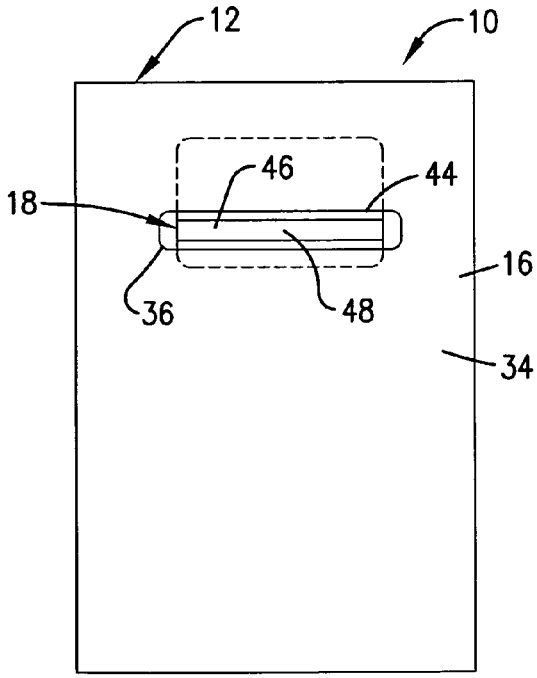
FIG. 4 is a rear elevational view showing an optional die cut window in the rear panel whereby the gift card is positioned relative to rear panel to position the encoded scannable strip in registry with the window.

In greater detail, the greeting card portion 12 may be provided of any conventional material such as paper, cardstock, laminate, plastic or the like sufficient to support the gift card thereon without collapsing. It may be appreciated that in addition to front panel 14 and rear panel 16, the greeting card may include a number of intermediate panels created by folding or coupling of the greeting card material, and to which the gift card 18 may be attached. As shown in the drawings, the front panel 14 is typically unitary with the rear panel 16, whereby the two panels are hingably connected along a fold line 26. In this configuration, the front panel 14 includes a front side 28 and a inner face 30, while the rear panel 16 has an inside face 32 and a back face 34. The rear panel 16 may be optionally provided with a die-cut window 36 located interiorly and thus within the surrounding margin of the rear panel 16. Any of the faces of the front panel and rear panel may be provided with preprinted indicia 38, as shown in FIGS. 1 and 3, and the indicia 38 may include text, photographs, artwork or other imagery as desired for suitable occasions. In addition, an area is preferably provided on the inner face 30 and the inside face 32 wherein an inscription 40 may be placed by the gift giver. The positioning of the indicia 38 and the area for receiving the inscription 40 is typically not covered by the gift card 18, but it may be appreciated that the greeting card portion 12 may be preprinted in such a way that indicia 38 may be preprinted on the inside face 32 as shown in phantom lines in FIG. 3 to reveal a "surprise" message readable after the gift card 18 is removed from the greeting card.

The gift card 18 is preferably constructed of synthetic resin or laminated in order to be suitably rigid as is well known to those skilled in the art, and includes a front surface 42 and a rear surface 44. The coupling means 20 holds the gift card 18 securely but temporarily with respect to the greeting card portion 12 such that the edges of the gift card are positioned inside the surrounding margin of the panels 14 and 16 The gift card 18 further preferably includes a scannable coded portion 46 which includes identifying code information corresponding to each particular gift card 18. Such a coded portion 46 may be provided by a magnetically coded strip 48, or alternatively by optically scannable bar coding or a coded chip carrying a transponder which supplies a signal when electronically interrogated or a transmitter which sends a signal to a receiver. Where the coded portion 46 is provided as a magnetically coded strip 48 or an optically scannable bar code, the gift card 18 is coupled to the greeting card 12 having the optional window 36 such that the coded portion 46 is in registry with the window 36 to facilitate scanning. The front surface 42 and/or rear surface 44 of the gift card 18 may be printed with indicia 50 which provides information as to the account holder who carries the credit from which the recipient may obtain goods or services, or further information as to the manner of use of the gift card 18. Also, the front surface 42 and/or rear surface 44 may be provided with a PIN number 52 for accessing an account corresponding to the gift card in a remote computer.

In use, a purchaser selects a greeting card with scanable card 10 having the desired preprinted indicia 38 and account holder. By way of example only as shown in the drawings, when the intended recipient is about to graduate, the indicia 38 may correspond to the occasion, and the gift card, once activated, may enable the holder to obtain a specified quantity of telephone services. The purchaser takes the combination card 10 to the vendor having a scanner. At the time of purchase, the vendor scans the coded portion 46 which in turn activates the account corresponding to the card in a computer database for a predetermined credit amount in either currency, such as dollars, or units of goods or services, such as telephone usage minutes. The window 36, although optional in that the gift card 18 may have the account already activated and accessible through the PIN number alone, is advantageous in that it does not detract from the overall appearance of the greeting card 12 and in that it facilitates scanning by both exposing the coded portion and directing the vendor to the area to be scanned. After any added personalized inscription 40, the combination greeting card and scanable card 10 is then ready for mailing or other delivery to the card recipient. When received, the gift card 18 is initially obscured from view by the front panel 14, but when the greeting card 12 is opened along the hinge line, the gift card 18 is revealed along with any inside indicia 38 or inscription 40, thus personalizing the gift delivery. Preferably, the gift card 18 is attached to the greeting card 12 by adhesive, such as a thermoplastic adhesive, which remains attached to the greeting card 12 when the gift card 18 is removed therefrom. The gift card 18, being smaller in overall dimensions of height and width than the greeting card, is thereby conveniently sized to be placed in the recipients wallet until used by scanning and/or entering the PIN number electronically on a telephone keypad or the like.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

The invention claimed is:

1. A greeting card comprising:

a foldable greeting card portion having at least a front panel and a rear panel, with the panels being hingedly interconnected along a fold line but otherwise unattached to one another so that the greeting card portion is freely openable about the fold line;

at least one of the panels having preprinted indicia thereon;

a gift card having a coded portion with coded information thereon; and coupling means for temporarily securing the gift card directly to one of the front and rear panels, with the gift card overlying a face area defined on the one panel to which the gift card is directly secured, the rear panel includes a window positioned in registry with the coded portion, said front panel concealing the gift card from view when the greeting card portion is folded and the gift card is secured, said face area of the one panel to which the gift card is directly secured including preprinted indicia that is concealed by the gift card until the gift card is removed.

2. A greeting card as set forth in claim 1, wherein at least one of said panels includes preprinted indicia corresponding to a particular occasion.

3. A greeting card as set forth in claim 1, wherein the coupling means includes adhesive.

4. A greeting card as set forth in claim 1, wherein the coded portion includes a personal identification number corresponding to the gift card.

5. A greeting card as set forth in claim 1, wherein the coded portion includes scannable information.

6. A greeting card as set forth in claim 5, wherein the coded portion includes a magnetic strip.

7. A greeting card as set forth in claim 5, wherein the coded portion includes a bar code.

8. A greeting card as set forth in claim 5, wherein the coded portion includes a transponder.

9. A greeting card as set forth in claim 5, wherein the coded portion includes a transmitter.

10. A greeting card as set forth in claim 1, wherein each of the panels of the greeting card portion has a width and length and the gift card portion has a width and a length which is less than the width and length of either of the panels.

11. A greeting card as set forth in claim 1, wherein at least one of the panels presents an area adapted to permit a personalized inscription to be written thereon.

12. A greeting card comprising;

a foldable greeting card portion including a plurality of panels, with adjacent ones thereof being hingedly interconnected along a fold line, each of said panels being otherwise unsecured to every other one of said panels so that the greeting card portion is freely openable about the fold line, said greeting card portion presenting opposite, outwardly oriented front and rear faces when folded, said front face being provided with preprinted indicia thereon corresponding with a particular occasion on which a gift is to be given, said panels presenting interior faces that are oriented inwardly between the front and rear faces when the greeting card portion is folded, with at least one of the interior faces presenting an area adapted to permit a personalized inscription to be written thereon; and a gift card having a coded portion with coded information thereon, said gift card being removably secured to said at least one of the interior faces such that the gift card is concealed from view by at least the front face when the greeting card portion is folded, a window being provided in the panel defining the rear face and any other panels between the rear face and the interior faces, with the coded portion being positioned in registry with the window.

13. A greeting card comprising;

an openable greeting card portion including at least a front panel and a rear panel, said front and rear panels presenting respective front and rear faces which are oriented outwardly in opposite directions when the greeting card portion is closed, said front and rear panels presenting interior faces that are oriented inwardly between the front and rear faces when the greeting card portion is closed, with at least one of the interior faces having preprinted indicia thereon; and a gift card having a coded portion with coded information thereon, said gift card being removably secured directly to said at least one of the interior faces with the rear panel including a window positioned in registry with the coded portion and, with at least some of the preprinted indicia being on said at least one of the interior faces in an underlying relationship with the gift card so as to be concealed by the gift card until the gift card is removed.

* * * * *